US010855007B2

(12) United States Patent
Glueck

(10) Patent No.: US 10,855,007 B2
(45) Date of Patent: Dec. 1, 2020

(54) ELECTRICAL PLUG-IN CONNECTION THAT CAN BE QUICKLY DISCONNECTED, FIXABLE PLUG-IN CONNECTION, AND METHOD FOR ESTABLISHING CONTACT BETWEEN AN ELECTRICAL CONTACT ELEMENT AND AN ELECTRICAL

(71) Applicant: REMA LIPPRANDT GMBH & CO. KG, Rheinbach (DE)

(72) Inventor: Bettina Glueck, Bonn (DE)

(73) Assignee: REMA LIPPRANDT GMBH & CO. KG, Rheinbach (DE)

( * ) Notice: Subject to any disclaimer, the term of this patent is extended or adjusted under 35 U.S.C. 154(b) by 196 days.

(21) Appl. No.: 16/305,063

(22) PCT Filed: May 24, 2017

(86) PCT No.: PCT/EP2017/062644
§ 371 (c)(1),
(2) Date: Nov. 28, 2018

(87) PCT Pub. No.: WO2017/207402
PCT Pub. Date: Dec. 7, 2017

(65) Prior Publication Data

US 2020/0335886 A1 Oct. 22, 2020

(30) Foreign Application Priority Data

May 30, 2016 (DE) ..... 10 2016 109 882

(51) Int. Cl.
*H01R 11/28* (2006.01)
*H01R 13/11* (2006.01)
(Continued)

(52) U.S. Cl.
CPC ..... *H01R 11/282* (2013.01); *H01R 13/111* (2013.01); *H01R 13/506* (2013.01); *H01R 43/26* (2013.01); *H01R 2201/26* (2013.01)

(58) Field of Classification Search
CPC ..... H01R 11/282; H01R 13/111
See application file for complete search history.

(56) References Cited

U.S. PATENT DOCUMENTS 5,445,533 A * 8/1995 Roscizewski ..... H01R 13/53 439/184
5,931,690 A 8/1999 Sai et al.
2013/0090009 A1 4/2013 Zhao

FOREIGN PATENT DOCUMENTS

DE 2428582 A1 1/1976
DE 201 17 275 U1 5/2002
(Continued)

*Primary Examiner* — Ross N Gushi
(74) *Attorney, Agent, or Firm* — Norman B. Thot

(57) ABSTRACT

A plug-in connection includes a first and second coupling part. The first coupling part includes a first contact element, an electrical cable, an insulation sleeve, and a first housing. The first contact element includes a base region and an outer region with an edge region, an external shell surface, and a slot. The electrical cable includes an electrical conductor, a connection region, and an insulation for the electrical conductor. The insulation sleeve surrounds the outer region and includes an external and internal shell surface. The first housing surrounds the base region, the insulation sleeve's external shell surface, and the connection region. The second coupling part includes a second contact element with an external shell surface over which the first contact element's outer region is slidable, and a second housing which encloses the second contact element and together therewith forms an annular space into which the first housing is insertable.

19 Claims, 4 Drawing Sheets

(51) Int. Cl.
*H01R 43/26* (2006.01)
*H01R 13/506* (2006.01)

(56) References Cited

FOREIGN PATENT DOCUMENTS

| | | | |
|---|---|---|---|
| DE | 10 2004 062 676 | A1 | 6/2006 |
| DE | 10 2011 015 825 | A1 | 10/2012 |
| DE | 10 2013 201 125 | A1 | 7/2014 |
| EP | 1 369 957 | A1 | 12/2003 |
| JP | H09-35702 | A | 2/1997 |
| WO | WO 2006/067166 | A2 | 6/2006 |

* cited by examiner

ELECTRICAL PLUG-IN CONNECTION THAT CAN BE QUICKLY DISCONNECTED, FIXABLE PLUG-IN CONNECTION, AND METHOD FOR ESTABLISHING CONTACT BETWEEN AN ELECTRICAL CONTACT ELEMENT AND AN ELECTRICAL

CROSS REFERENCE TO PRIOR APPLICATIONS

This application is a U.S. National Phase application under 35 U.S.C. § 371 of International Application No. PCT/EP2017/062644, filed on May 24, 2017 and which claims benefit to German Patent Application No. 10 2016 109 882.5, filed on May 30, 2016. The International Application was published in German on Dec. 7, 2017 as WO 2017/207402 A1 under PCT Article 21(2).

FIELD

The present invention relates to an electrical plug-in connection that can be quickly disconnected for high-current vehicle applications, for example, for an electrical connection between an electrical storage battery and a drive device of an industrial truck. The present invention also relates to a fixable and disconnectable electrical plug-in connection and a method for producing the electrically conductive connection between an electrical contact element and an end region of an electrical conductor which protrudes out of an insulation.

BACKGROUND

The practice of maintaining a stock of multiple, charged electrical storage batteries (also referred to as "accumulators") for an industrial truck, and exchanging a storage battery currently in use when it has reached a certain discharge state for a fully-charged storage battery is known as a way of enabling operation of electrically-powered industrial trucks without longer interruptions, even without a quick charge. It is thereby desirable to be able to quickly and easily decouple each storage battery in the vehicle, as far as possible without tools, from a drive device of the industrial truck, and to couple a further, charged storage battery with this drive device with as little time loss as possible. The battery terminals known in the prior art and are widespread but are only somewhat suitable for this purpose because it is always necessary to operate a locking screw upon a decoupling and/or coupling in order to establish and/or break an electrical connection between the drive device and the electric storage battery. Another disadvantage is that these known locking means make it necessary to use a turning tool, which can cause serious problems, in particular if the batteries are arranged in the industrial truck in a position which is poorly accessible from the outside. Known terminal connections are also regularly exposed to negative external conditions, for example, moisture and dirt, so that a good electrical connection requires, over time, the use of additional measures, such as so-called terminal grease.

Plug-in connections are known in numerous, different configurations. DE 201 17 275 U1 describes a plug-in connection in which a conductor wire of a cable can be inserted into a transverse bore of a socket or pin contact to achieve a positive fit. DE 10 2013 201 125 A1 and US 2013/0090009 A1 each describe a plug-in connection for use in the automotive industry, each having a two-piece inner conductor comprising a sleeve-shaped first inner conductor part for receiving a mating contact element, and a separate, pin-shaped second inner conductor part connected to a conductor wire of a cable. The plug-in connection has a relatively large number of separate components, so that the plug-in connection is relatively complex in construction and relatively expensive to manufacture. The plug-in connection is accordingly relatively large and requires an accordingly large assembly space.

SUMMARY

An aspect of the present invention is to provide an electrical plug-in connection which can be quickly disconnected, which has a space-saving construction, and which is safe to handle.

In an embodiment, the present invention provides an electrical plug-in connection for a high-current vehicle application which is configured to be quickly disconnected. The electrical plug-in connection includes a first coupling part and a second coupling part. The first coupling part comprises a first electrical contact element, an electrical cable, an insulation sleeve and a first housing. The first electrical contact element comprises a base region and an outer region. The outer region comprises an edge region, an external shell surface, and at least one slot which extends from the base region to the edge region opposite the base region. The electrical cable comprises an electrical conductor, a connection region, and an insulation which sheathes the electrical conductor. The electrical conductor comprises an end region which protrudes out of the insulation and which is connected to the base region of the first electrical contact element to allow an electrical conduction. The insulation sleeve surrounds the outer region of the first electrical contact element and comprises an external shell surface and an internal shell surface. The internal shell surface is spaced from the external shell surface of the outer region of the first electrical contact element. The first housing surrounds each of the base region of the first electrical contact element, the external shell surface of the insulation sleeve, and the connection region of the electrical cable. The first housing is produced by an encapsulation with a plastic material. The second coupling part comprises a second electrical contact element comprising an external shell surface over which the outer region of the first electrical contact element can be slid, and a second housing which encloses the second electrical contact element and which, together with the second electrical contact element, forms an annular space into which the first housing can be inserted.

BRIEF DESCRIPTION OF THE DRAWINGS

The present invention is described in greater detail below on the basis of embodiments and of the drawings in which.

DETAILED DESCRIPTION

Figure 1:
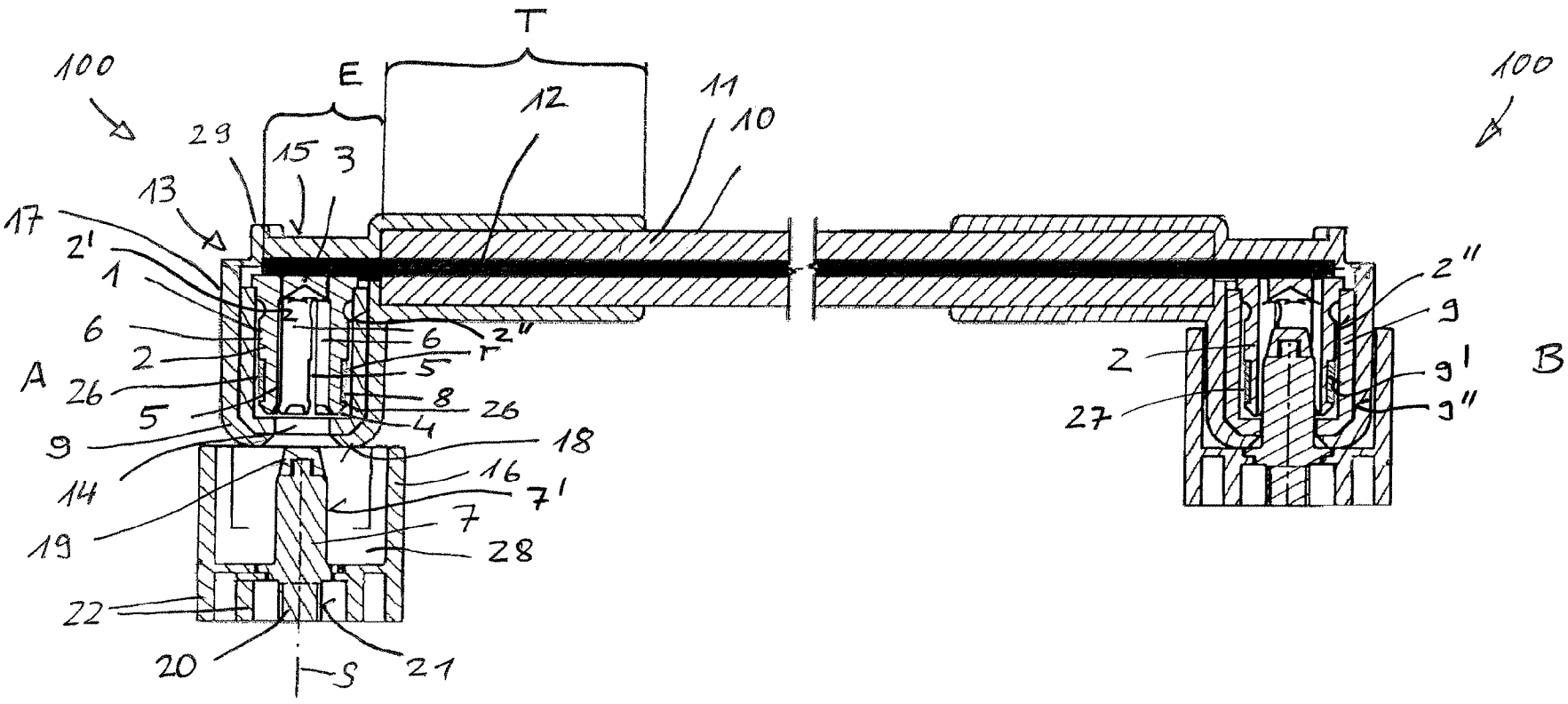
FIG. 1 schematically shows a first embodiment of an electrical plug-in connection that can be quickly disconnected according to the present invention where the left portion is before the mating, and the right portion after the mating, of the first electrical contact element with the second electrical contact element.

The electrical plug-in connection that can be quickly disconnected, according to the present invention comprises a first, for example, approximately cup-shaped electrical contact element which can, for example, have a base region and, for example, an outer region. The outer region can, for example, be configured with at least one slot which can, for example, extend from the base region up to, for example, the edge region of the outer region opposite the base region. There can, for example, be a plurality of slots distributed around the circumference of the outer region. The electrical plug-in connection according to the present invention also comprises a cable, which can, for example, comprise an electrical conductor and, for example, an insulation which surrounds the conductor. An end region of the conductor projecting out of the insulation can, for example, be connected, in particular soldered or welded, to allow for an electrical conduction to the base region of the first contact element. This electrical plug-in connection also has an insulating sleeve surrounding the outer region of the first electrical contact element comprising internal and external shell surfaces. The internal shell surface of the insulating sleeve is spaced from the external shell surface of the outer region of the electrical contact element. This provides that adjacent electrical contact tongues which are separated from each other by the slots can be displaced outwardly when a second contact element which pushes against the contact tongues from the inside is slid therein. The electrical plug-in connection according to the present invention further comprises a first housing produced by encapsulation with a plastic material which surrounds the base region of the first contact element and the external shell surface of the insulation sleeve, as well as a connection region of the cable. The encapsulation creates a sheathing which completely surrounds all electrically conductive parts of the first contact element, as well as a part of the insulation of the electrical conductor, except for an opening which must allow the passage of a second electrical contact element. Due to the radial spacing between the internal shell surface of the insulating sleeve and the external shell surface of the first contact element, a displacement of the individual contact tongues during the insertion of a contact pin is possible, even after encapsulation. According to the present invention, the electrical plug-in connection comprises a second electrical contact element having an external shell surface over which the first outer region of the first electrical contact element can be slid, wherein the second electrical contact element can, for example, be surrounded by a second housing which forms, together with the second electrical contact element, an annular space into which the first housing can be inserted. The second housing can, for example, surround and seal, with its internal shell surface, the external shell surface of the first housing when in the mated state. The second housing can, for example, be made of an elastic material therefor, for example, of a rubber-elastic material. The particularly good sealing effect which is achieved when the components are mated provides effective protection against negative external influences on the electrical contact between the first and second contact elements even without additional aids such as terminal grease, etc.

The further fixable and disconnectable electrical plug-in connection according to the present invention likewise comprises a first coupling part having a first electrical contact element which comprises a base region and an outer region, the outer region having at least one slot extending from the base region to an edge region of the outer region opposite the base region, having an electrical cable which comprises an electrical conductor and an insulation sheathing this conductor, wherein an end region of the conductor which projects out of the insulation is connected to the base region of the first contact element to allow electrical conduction, having an insulation sleeve which surrounds the outer region of the first electrical contact element, having an external shell surface and an internal shell surface, wherein the internal shell surface is spaced apart from an external shell surface of the outer region of the electrical contact element, and having a first housing which surrounds the base region of the first contact element and the external shell surface of the insulating sleeve, as well as a connection region of the electrical cable. A second coupling part, in particular a counter-coupling part, in turn comprises a second electrical contact element having an external shell surface over which the outer region of the first electrical contact element can be slid, the second electrical contact element being surrounded by a second housing which forms, together with the second contact element, an annular space into which the first housing can be inserted. The fixable and disconnectable electrical plug-in connection to this extent corresponds to the electrical plug-in connection that can be quickly disconnected, as described above. To secure the plug-in connection, the fixable and disconnectable electrical plug-in connection has a retaining clip for fixing the first housing to the second housing. This makes it possible to provide a stronger and in particular a more secure hold over time of one coupling part on the other coupling part, particularly when the plug-in connection is used in vehicles regularly subjected to shock, vibration, and/or acceleration forces during operation. The retaining clip also makes it possible to determine quickly and easily, for example, after a certain period of use of the vehicle, whether the first coupling part is still completely and securely inserted into the second coupling part, or whether the plug-in connection has at least partially loosened. The retaining clip can, for example, be constructed separately, and can, for example, have a shape which surrounds the two housings at least partially.

The retaining clip can, for example, be mounted to allow a pivoting about an axis of rotation. The retaining clip can thereby surround the two housings in a particularly simple manner, and fix them to each other. The retaining clip is thereby not provided separately, and cannot be lost when the electrical connection is separated. The retaining clip can, for example, be mounted on the second housing, and can be temporarily fixed to the first housing, for example, via a latch engaging in a recess. The axis of rotation can, for example, be arranged perpendicular to a mating direction in which the plug-in connection is made by sliding. The retaining clip can, for example, be arranged laterally to a peripheral wall of the second housing. The second coupling part, and thus the entire plug-in connection, can thereby be provided a particularly space-saving construction.

The retaining clip can, for example, have a first clip portion and a second clip portion which is angled with respect to the first clip portion. The retaining clip can thereby be placed around the two housings in a particularly simple manner. One of the clip portions can in particular be used as a handle with which an operator can grip and move, in particular, rotate, the retaining clip. The first clip portion can, for example, be designed to correspond to the outer contour of the second housing, and the second clip portion can, for example, be designed to correspond to the outer contour of the first housing. Each clip portion can have one or more clip arms.

The first housing can, for example, be made of several parts. The first housing can, for example, have a top part facing the cable connection region and a bottom part facing away from the cable connection region. These housing parts can each be produced as cast parts. The housing can thereby be produced in a particularly simple and cost-effective manner. In an alternative, likewise advantageous embodiment, the plug-in connection can, for example, comprise a first housing which surrounds the base region of the first contact element and the external shell surface of the insulating sleeve, as well as a connection region of the cable, wherein the housing is constructed as a single piece and is produced by encapsulation with a plastic material.

The first housing can, for example, have a protective edge region on an outer side which is arranged radially spaced from an external shell surface of the first housing and which at least partially radially surrounds the outer surface. It should be clear that this embodiment can be used both for the first housing produced by encapsulation as well as for a multi-part first housing. The protective edge region may, in the coupled state, surround the second housing at least partially, radially outside thereof, in particular on a peripheral side. This may, for example, achieve an improved contact protection and an improved seal of the plug-in connection.

A clearance into which the second housing can be inserted, at least with a free end region thereof, can, for example, be included between the external shell surface and the protective edge section. The first housing can as a result surround the second housing in this region so that a type of dome is formed around the second housing and, consequently, the plug-in connection is particularly well protected against, for example, the splashing of water.

The first housing and the second housing can, for example, each have at least one guide element, which respectively correspond to each other, for the purpose of aligning the two housings to each other during the connection of the two coupling parts. The plug-in connection can thereby be mated particularly easily and quickly. The guide elements can also serve as protection against rotation of the two coupling parts relative to each other. The guide elements can in particular be designed so that the first coupling part can be coupled in only one specific orientation with the second coupling part. This makes it possible to prevent, for example, misalignments of the two coupling parts, especially the electrical contacts.

The first housing and the second housing can, for example, each have at least one mutually corresponding fixing element for at least temporarily fixing the two housings to each other. The two coupling parts can thereby be connected in a particularly secure manner. The first coupling part, after insertion into the second coupling part, can, for example, be temporarily fixed to the second coupling part, thereby preventing one of the coupling parts from falling out or becoming detached, this only being possible via a special handle or via the application of force. This provides a better handling thereof for the operator, for example, to move the retaining clip into another fixation position.

The fixing element can, for example, have a latch or clip constructed on one of the housings, and a recess arranged on the other housing, corresponding with the latch. There can, for example, be a housing portion formed in the mating direction, for example, designed as a guide element, having latches which can, for example, protrude radially inwardly from the first coupling part for the purpose of engaging in a corresponding recess constructed on the second housing. The temporary fixing element can thereby be produced in a particularly cost-effective manner and can have a particularly easy to operate design.

The end region of the conductor can, for example, be soldered or welded to the base region of the first contact element. This can provide a particularly durable and secure connection between the first contact element and the conductor wire of the cable.

To allow a durable contact of the outer region of the first electrical contact element with, for example, a contact pin, to be realized even after frequent mating operations, a spring washer can, for example, be provided which can, for example, surround a portion of the length of the outer region. The spring washer can, for example, be made of a spring steel. So that this spreading movement of the contact tongues separated by the slots is not limited by impacting the internal shell surface of the insulation sleeve, the outer region can, for example, include a groove into which the spring washer engages to such an extent that it does not protrude outwardly beyond the shell surface of the outer region of the first electrical contact element. This also eliminates the risk of the spring washer slipping or sliding in the mating direction.

A housing which is used in connection with an electrical plug-in connection that can be quickly disconnected, in particular a housing which has one or more of the features noted above, can, for example, comprise an edge which runs in the mating direction and which transitions, via a chamfer or curve, into the external shell surface of the housing. It has surprisingly been found that a housing adapted with such a design is suitable for cooperating, in a manner creating a seal, with a counter-housing which surrounds the external shell surface when in the mated state if made of an elastic material, and in particular a rubber-elastic material.

Because of the annular space between the second housing and the second electrical contact element, into which the first housing must be insertable during the mating, the second housing has a regular opening that allows an operator to use a finger to contact the second contact element. There can, for example, therefore be a contact protection made of an insulating material on the end of the second contact element which leads in the mating direction.

In order to avoid mating with reversed polarity, the external shell surface of the first housing and the annular space of the second housing can, for example, be designed with specific polarity, in particular with grooves and/or projections.

The present invention also relates to a method for producing the electrically conductive connection between the base region of the first electrical contact element, which has an inner surface and an outer surface, and the end regions of the electrical conductor of an electrical plug-in connection, which protrude from the insulation, as described above. In this method, the end region of the electrical conductor is brought into contact with the outer surface of the base of the first electrical contact element via a first contacting tool. Instead of the second contact element, a second contacting tool is inserted into the outer region until the contacting tool comes to rest against the inner surface of the base region. Energy is then applied to the first and/or second contacting tool(s), causing a permanent connection between the first electrical contact element and the conductor. This energy can, for example, be mechanical energy which applies pressure between the base and the conductor, assuming that the base and/or conductor are designed so that they can be permanently press-fit with each other. It is, for example, also possible to excite mechanical vibrations in the base and/or the conductor in order to achieve a friction weld between the base and conductor. The first and/or second contacting tools can be designed as parts of sonotrodes therefor. It is also possible, for example, to design the first and second contacting tools as electrodes, and to achieve a welded connection by the application of electrical power.

Irrespective of the type of applied energy which is chosen to produce the permanent connection in each case, it is important that the second contacting tool acts on the inner surface of the base region since this prevents damage to the outer region, with its contact tongue, by a potential application of energy.

The present invention will now be described further below under reference to the drawings.

The embodiment of the electrical plug-in connection that can be quickly disconnected, illustrated in FIG. 1 and designated as a whole by 100, is in particular provided for connecting a pole of an electric storage battery to an electrical connection of a drive device of an industrial truck. In FIG. 1, the left side is the side of the storage battery A, and the right side is the side of the drive B. On the side of the storage battery A, the electrical plug-in connection 100 is shown before the mating operation, while the side of the drive B shows the electrical plug-in connection 100 after the mating operation. The plug-in connection is the same on the storage battery side A and the drive side B so that the statements set forth below apply to both sides.

The electrical plug-in connection 100 comprises a first electrical contact element 1 which is assigned to a first coupling part 101 (which is not shown here in greater detail) which is approximately cup-shaped, and which comprises an outer region 2 with an internal shell surface 2' and an external shell surface 2", as well as a base region 3. The electrical contact element 1 is made of an electrically highly conductive material, such as a copper alloy. The outer region 2 comprises a plurality of slots 5 extending from the base region 3 to the edge region 4, of which only three are visible in FIG. 1. Adjacent slots 5 each border one contact tongue 6. The contact tongues 6 border the internal shell surface 2' of the outer region 2, the diameter of which is adapted to the outer diameter of a second electrical contact element 7 so that the first electrical contact element 1 can be slid over an external shell surface 7' of the second electrical contact element 7, with the contact tongues 6 coming to rest thereon.

A spring washer 8 surrounds the external shell surface 2" of the outer region 2. The spring washer 8 provides that the contact tongues 6 of the first electrical contact element 1 come to rest against the second electrical contact element 7 even after multiple mating operations. The spring washer 8 rests in an annular groove 26 so that it cannot slip off of the contact tongues 6 in the mating direction along sliding axis S, and does not project beyond the external shell surface 2" of the outer region 2.

The outer region 2 of the first electrical contact element 1 is surrounded by an insulation sleeve 9. The internal shell surface 9' of the insulation sleeve 9 is at a radial distance/spacing r from the external shell surface 2" of the outer region 2. An annular space 27 is accordingly formed between the internal shell surface 9' and the external shell surface 2" so that it is possible for the contact tongues 6 to spread apart upon mating with a second electrical contact element, within the limits prespecified by the distance/spacing r. The insulation sleeve 9 can therefore be formed and prefabricated from a rigid material.

The first electrical contact element 1 is electrically connected to an electrical cable 10 which has an insulation 11 and an electrical conductor 12. For this purpose, the electrical conductor 12 is freed of the insulation 11 in an end region E of the electrical cable 10. The length of the end region E corresponds approximately to the outer diameter of the first electrical contact element 1. The end region E lies flat against the outer side of the base region 3 and is connected thereto permanently by force or by a positive-fit connection, or a material connection by soldering or welding. "Flat" in this case means that the electrical conductor 12 in the connection region is aligned approximately perpendicular to the mating direction S in which the first electrical contact element 1 and the second electrical contact element 7 can be mated.

The insulation sleeve 9, the base region 3 with the electrical conductor 9 attached thereto, and also an adjacent region T of the insulation 11 are surrounded by a first housing 13 which is made by encapsulation. The first housing 13 surrounds the above-mentioned components and/or regions in a permanent and gas-tight manner, with the exception of an opening 14 which extends into the first electrical contact element 1, and through which the second electrical contact element 7 can be inserted. The diameter of the opening 14 is only slightly greater than the diameter of the internal shell surface 2' of the first electrical contact element 1.

On the side remote from the electrical cable 10, beyond the sliding axis/mating direction S, the first housing 13 has a projection 29 which protrudes from a flat surface 15. The projection 29 serves to prevent a fixing element, via which the first electrical contact element 1 and the second electrical contact element 7 can be fixed when in the mated state (which are not shown in the drawings and which may potentially be present) from slipping off.

The second electrical contact element 7, which is assigned to a second coupling part (which is not illustrated in greater detail), is designed in the embodiment shown in the drawing as a plug contact with an approximately cylindrical cross-section. The second electrical contact element 7 is surrounded by a second housing 16 which is approximately cup-shaped and which is made of an elastically resilient material. The diameter of the second housing 16 is adapted to the outer diameter of the region of the first housing 13 surrounding the outer region 2 of the first electrical contact element 1, which in this case has an external shell surface 17, so that this region can be inserted into the second housing 16 while slightly widening the same. In order to facilitate the insertion process, the external shell surface 17 of the first housing 13 transitions with a curve in the mating direction S into the leading edge 18 of the first housing 13. The second housing 16 forms an annular space 28 with the external shell surface 7' of the second electrical contact element 7.

The second electrical contact element 7 has a contact protection 19 made of an insulating material on its end which leads in the mating direction S. The contact protection 19 is press-fit to the second electrical contact element 7, for which purpose it has an extension which engages in a corresponding bore of the contact protection 19 with a friction fit.

The end region 20 of the second electrical contact element 7, pointing in the opposite direction from the contact protection 19, has an external thread 21. The external thread 21 is included for screwing the second electrical contact element 7 onto a battery terminal or an electrical connector of a drive unit.

The end region 20 is surrounded radially by housing regions 22.

The first housing 13 can have grooves and/or projections, and the second housing 16 can have complementary projections and/or grooves. Their arrangement and/or design can have a specific polarity, thereby preventing confusion of positive and negative poles and a mating with reverse polarity.

The method with which the end region E of the electrical conductor 12 of the electrical cable 10 which is electrically connected to the base region 3 of the first electrical contact element 1 will now be described under reference to FIGS. 2 and 3.

Figure 2:
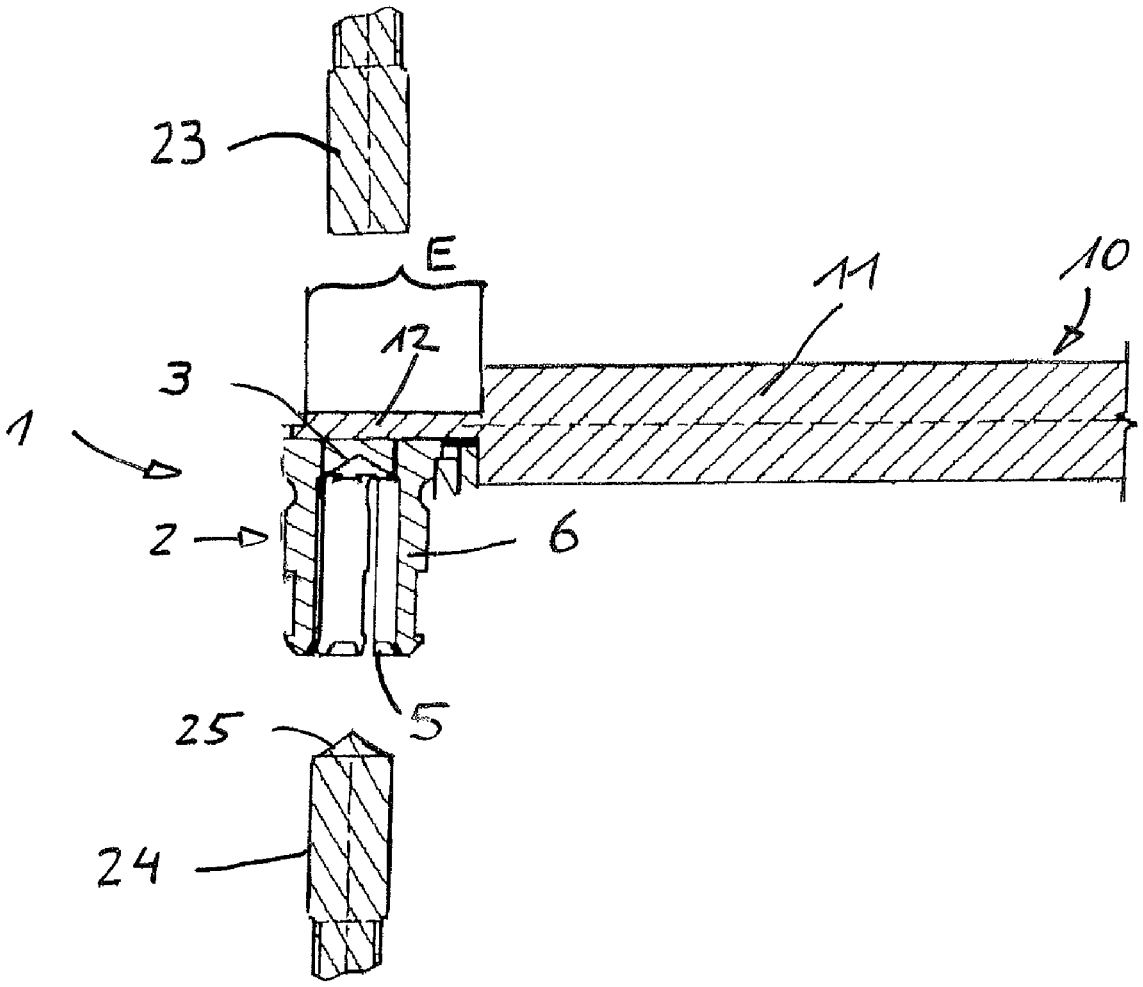
FIG. 2 schematically shows the preparation of the permanent connection of the first electrical contact element with the electrical conductor according to the first embodiment.

As shown in FIG. 2, the electrical conductor 12 is first placed against the outer surface of the base region 3 in the end region E. A first contacting tool 23 and a second contacting tool 24 are provided. The first contacting tool 23 is suitable for pressing the electrical conductor 12 against the outer surface of the base region 3. The second contacting tool 24 is designed so that it can be inserted in the mating direction S into the space enclosed by the contact tongues 6. The end 25 which leads in the mating direction S is designed to be complementary to the contour of the inner side of the base region 3 so that it can be brought into flat contact therewith. If the first contacting tool 23 is in contact with the electrical conductor 12, and the second contacting tool 24 is in contact with the inner side of the base region 3, energy is applied to at least one of the first contacting tool 23 and the second contacting tool 24 so that the electrical conductor 12 forms a connection to the base region 3 on the outer side thereof, wherein said connection can no longer be separated without destruction, and is therefore called a permanent connection. By way of example only, named here is the application of electrical energy to produce an electric welding, or an application of vibrational energy, wherein one or both of the contacting tools are designed as parts of sonotrodes, thereby achieving a friction welding. After the first contacting tool 23 and the second contacting tool 24 are removed, the insulation sleeve 9 is placed and the subsequent encapsulation to form the housing 13 is performed in the known manner.

Figure 3:
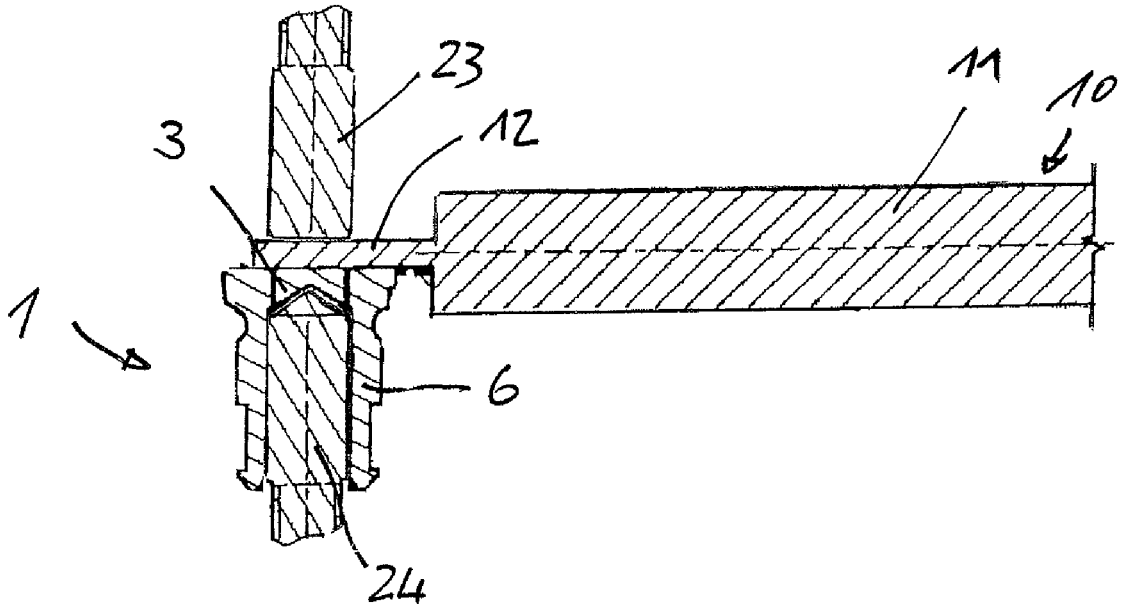
FIG. 3 again schematically shows the method step of permanently connecting the first electrical contact element with the electrical conductor according to the first embodiment.
Figure 4:
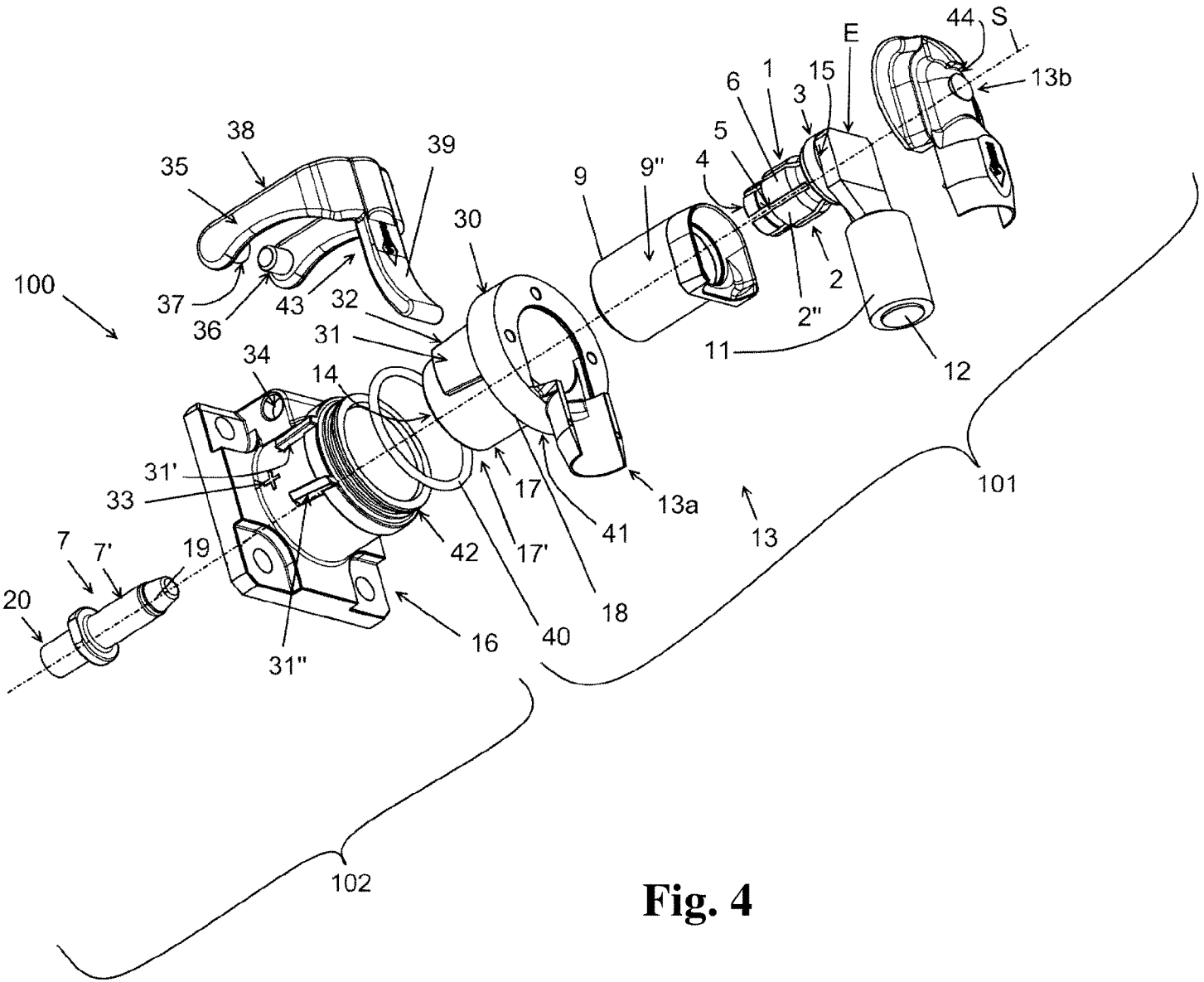
FIG. 4 schematically shows a second embodiment of a plug-in connection according to the present invention in a perspective exploded view.

The second embodiment of a plug-in connection 100 according to the present invention is shown in FIG. 4 and likewise comprises a first coupling part 101 and a second coupling part 102 which substantially correspond, as far as the components which are arranged in the interior of the first housing 13, the second housing 16 and the electrical components, to the embodiments shown in FIGS. 1 to 3. Numerous distinguishing features are, however, present in the external configuration of the first coupling part 101 and the second coupling part 102.

The plug-in connection 100 shown in FIG. 4 has a first coupling part 101 which, like the first embodiment, has a first electrical contact element 1 comprising a base region 3, contact tongues 6 forming an outer region 2 and separated by slots 5, with a free end or edge 4. On the base region 3, the first electrical contact element 1 is connected with an electrical conductor 12 of an electrical cable 10, for example, by soldering. The first electrical contact element 1 is radially surrounded, at least in the outer region 2, by an insulation sleeve 9 and a first housing 13. In this example, the first housing 13 is formed in two parts and has a first housing part 13*a* and a second housing part 13*b*. The second housing part 13*b* surrounds at least the connection point between the first electrical contact element 1 and the electrical conductor 12 which is provided as a wire. The first housing part 13*a* surrounds the insulation sleeve 9 and the first electrical contact element 1 situated therein. The first housing part 13*a* is constructed internally substantially like the first housing 13 shown in FIG. 1. In the shown second embodiment are additionally provided three connection points on an outer side of the first housing part 13*a*, the three connection points being provided, for example, as screw holes, for securing the second housing part 13*b*, a protective edge section 30 which surrounds an external shell surface 17 of the first housing part 13*a* at a radial distance therefrom, and also a first guide element 31 which adjoins the protective edge section 30 for aligning the first housing 13 relative to the second housing 16 during the coupling of the first coupling part 101 and the second coupling part 102. In an alternative embodiment not shown in FIG. 4, the first housing 13 is formed integrally and in one piece, in particular as a housing which surrounds the base region 3 of the first electrical contact element 1 and the external shell surface 9" of the insulation sleeve 9, as well as a connection region of the electrical cable 10, and which can, for example, be produced by encapsulation with a plastic material.

The protective edge section 30 forms a clearance 41 in which the second housing 16 can be inserted at least with a free end region 42 thereof during the coupling of the first coupling part 101 and the second coupling part 102. A protruding latch 32 (which is not shown in FIG. 4) is formed on the guide element 31 on a lateral surface facing the first electrical contact element 1, which can be brought into engagement in a recess 33 formed in the second coupling part 102 for a temporary fixation of the first coupling part 101 to the second coupling part 102. A sealing ring 40 can advantageously be arranged on the end region 42 of the second housing 16, arranged for coupling the first coupling part 101 to the second coupling part 102 so that the electrical plug-in connection 100 is sealed from the environment.

The second coupling part 102 comprises, like the first embodiment, a second electrical contact element 7, having an external shell surface 7' over which the outer region 2 of the first electrical contact element 1 can be slid, wherein the second electrical contact element 7 is surrounded by the second housing 16 and forms, together with the second electrical contact element 7, an annular space 28 into which the first housing 13 can be inserted. On an outer side, the second housing 16 has two second guide elements 31' and 31" which correspond to the first guide element 31 of the first housing 13. These are formed in the shown embodiment as webs 31', 31" which conically converge in the mating direction S and which guide the (first) guide element 31 on two end faces upon insertion of the first coupling part 101. In the shown embodiment, the second housing 16 has a recess 33 between these webs 31', 31" for receiving the latches arranged on the (first) guide element 31 to temporarily fix the first coupling part 101 and the second coupling part 102 to each other. The second housing 16 also has a receiving sleeve 34 for mounting or rotationally fastening a retaining clip 35.

The retaining clip 35 serves to permanently fix the first housing 13 to the second housing 16, and is formed as a separate component. The retaining clip 35 is mounted using bolts 37 in a manner which allows pivoting or rotating on the receiving sleeve 34 of the second housing 16 about an axis of rotation 36. The axis of rotation 36 in this case is perpendicular and offset from the mating direction S. The retaining clip 35 has a first clip portion 38 and a second clip portion 39 which is angled with respect to the first clip portion 38. The first clip portion 38 is U-shaped and has two clip arms each extending from the bolt 37 to the second clip portion 39. The clip arms are brought together in the region of the adjoining second clip portion 39. The second clip portion 39 is curved so that it is designed to be particularly suitable as a handle for operating the retaining clip 35. A latch 43 (which is not shown in greater detail) is arranged on the second clip portion 39 and can engage in a recess 44 formed on the second housing part 13*b* of the first housing 13 to fix the retaining clip 35.

The embodiment described above provides, despite vibrations, shocks or other forces, a permanent connection of the first electrical contact element 1 and the second electrical contact element 7. In a coupling process, the first coupling part 101 is first pushed with its first housing 13, in a translational movement, over the guide elements 31, 31', 31", with the retaining clip 35 open, aligned with the second housing 16 of the second electrical coupling part 102 and along the mating direction S, in the direction of the second coupling part 102, until the latch 32 arranged on the (first) guide element 31 engages in the recess 33. In this state, the operator can release the first coupling part 101 and pivot the retaining clip 35, via the second clip portion 39 designed as a handle, over the first coupling part 101 until the retaining clip 35 with the latch 43 engages in the recess 44 behind a shoulder. The release of the electrical plug-in connection 100 is performed by a slight lifting of the second clip portion 39 formed as a handle, to release the retaining clip 35 from the first housing 13, in particular the latch 43 from the recess 44, and by a sideways pivoting of the retaining clip 35. The first coupling part 101 can subsequently be pulled out of the second coupling part 102 parallel to the mating direction S by releasing the latch 32 out of the recess 33.

It should be clear that the scope of protection of the present invention is not limited to the described embodiments and/or the combinations of features shown. The structure of the housing and the retaining clip can in particular be modified without changing the essence of the present invention. Reference should also be had to the appended claims.

LIST OF REFERENCE NUMERALS

100 electrical plug-in connection
101 first coupling part
102 second coupling part
1 first electrical contact element
2 outer region
2' internal shell surface
2" external shell surface
3 base region
4 edge region
5 slots
6 contact tongues
7 second electrical contact element
7' external shell surface
8 spring washer
9 insulation sleeve
9' internal shell surface
9" external shell surface
10 electrical cable
11 insulation
12 electrical conductor
13 first housing
13*a* first housing part
13*b* second housing part
14 opening
15 surface
16 second housing
17 external shell surface
17' outer side
18 leading edge
19 contact protection
20 end region
21 external thread
22 housing regions
23 first contacting tool
24 second contacting tool
25 end
26 groove
27 annular space
28 annular space
29 projection
30 protective edge section
31, 31', 31" guide element
32 latch
33 recess
34 receiving sleeve
35 retaining clip
36 axis of rotation
37 bolt
38 first clip portion
39 second clip portion
40 sealing ring
41 clearance
42 end region
43 latch
44 recess
A storage battery side
B drive side
E end region
r distance/spacing
S sliding axis/mating direction
T region

What is claimed is:

1. An electrical plug-in connection for a high-current vehicle application which is configured to be quickly disconnected, the electrical plug-in connection comprising:

a first coupling part comprising, a first electrical contact element which comprises a base region and an outer region, the outer region comprising an edge region, an external shell surface and at least one slot which extends from the base region to the edge region opposite the base region, an electrical cable which comprises an electrical conductor, a connection region and an insulation which sheathes the electrical conductor, the electrical conductor comprising an end region which protrudes out of the insulation and which is connected to the base region of the first electrical contact element to allow an electrical conduction, an insulation sleeve which surrounds the outer region of the first electrical contact element and which comprises an external shell surface and an internal shell surface, the internal shell surface being spaced from the external shell surface of the outer region of the first electrical contact element, and a first housing which surrounds each of the base region of the first electrical contact element, the external shell surface of the insulation sleeve, and the connection region of the electrical cable, the first housing being produced by an encapsulation with a plastic material; and a second coupling part comprising, a second electrical contact element comprising an external shell surface over which the outer region of the first electrical contact element can be slid, and a second housing which encloses the second electrical contact element and which, together with the second electrical contact element, forms an annular space into which the first housing can be inserted.

2. An electrical plug-in connection for a high-current vehicle application which is fixable and disconnectable, the electrical plug-in connection comprising:

a first coupling part comprising:

a first electrical contact element which comprises a base region and an outer region, the outer region comprising an edge region, an external shell surface and at least one slot which extends from the base region to the edge region of the outer region opposite the base region, an electrical cable which comprises an electrical conductor, a connection region and an insulation which sheathes the electrical conductor, the electrical conductor comprising an end region which protrudes out of the insulation and which is connected to the base region of the first electrical contact element to allow an electrical conduction, an insulating sleeve which surrounds the outer region of the first electrical contact element and which comprises an external shell surface and an internal shell surface, the internal shell surface being spaced from the external shell surface of the outer region of the first electrical contact element, and a first housing which surrounds each of the base region of the first electrical contact element, the external shell surface of the insulating sleeve, and the connection region of the electrical cable;

a second coupling part comprising, a second electrical contact element comprising an external shell surface over which the outer region of the first electrical contact element can be slid, and a second housing which encloses the second electrical contact element and which, together with the second electrical contact element, forms an annular space into which the first housing can be inserted; and a retaining clip configured to fix the first housing to the second housing.

3. The electrical plug-in connection as recited in claim 2, wherein the retaining clip is mounted to allow a pivoting about an axis of rotation.

4. The electrical plug-in connection as recited in claim 2, wherein the retaining clip comprises a first clip portion and a second clip portion which is angled with respect to the first clip portion.

5. The electrical plug-in connection as recited in claim 2, wherein the first housing is constructed of a plurality of pieces.

6. The electrical plug-in connection as recited in claim 2, wherein the first housing further comprises an external shell surface and a protective edge section on an outer side of the first housing, the protective edge section being arranged radially spaced from the external shell surface and to at least partially surround the external shell surface radially.

7. The electrical plug-in connection as recited in claim 6, wherein, the first housing further comprises a clearance between the external shell surface and the protective edge section, the second housing further comprises a free end region, and the second housing is insertable into the clearance via the free end region.

8. The electrical plug-in connection as recited in claim 2, wherein the first housing and the second housing each further comprise at least one guide element which mutually correspond to each other to align the first housing and the second housing relative to each other.

9. The electrical plug-in connection claim 2, wherein the first housing and the second housing each further comprise at least one fixing element which mutually correspond to each other to at least temporarily fix the first housing and the second housing to each other.

10. The electrical plug-in connection as recited in claim 9, wherein, a first fixing element of the at least one fixing element comprises a latch arranged on one of the first housing or the second housing, a second fixing element of the at least one fixing element comprises a recess arranged on one of the first housing or the second housing which does not comprise the first fixing element, and the latch corresponds to the recess.

11. The electrical plug-in connection as recited in claim 2, wherein the end region of the conductor is soldered or welded to the base region of the first electrical contact element.

12. The electrical plug-in connection as recited in claim 2, further comprising:

a spring washer which surrounds a portion of a length of the outer region of the first electrical contact element.

13. The electrical plug-in connection as recited in claim 12, wherein the outer region of the first electrical contact element comprises a groove to receive the spring washer.

14. The electrical plug-in connection as recited in claim 2, wherein the second housing is made of an elastic material.

15. The electrical plug-in as recited in claim 2, wherein the second electrical contact element further comprises a contact protection made of an insulating material on an end which leads in a mating direction.

16. The electrical plug-in connection as recited in claim 2, wherein the first housing further comprises an external shell surface and an edge which runs perpendicular to a mating direction, the edge being configured to transition into the external shell surface via a chamfer or a curve.

17. The electrical plug-in connection as recited in claim 16, wherein the external shell surface of the first housing and the annular space of the second housing are designed to comprise a specific polarity.

18. The electrical plug-in connection as recited in claim 17, wherein, the external shell surface of the first housing comprises at least one of grooves and projections, and the annular space of the second housing comprises at least one of projections and grooves which are complementary to the at least one of grooves and projections of the external shell surface.

19. A method for producing an electrically conductive connection between the base region of the first electrical contact element, the base region comprising an inner surface and an outer surface, and the end region of the electrical conductor of the electrical plug-in connection as recited in claim 2, which protrudes from the insulation, the method comprising:

providing a first contacting tool;

providing a second contacting tool;

bringing the end region of the electrical conductor into contact with the outer surface of the base region with the first contacting tool;

introducing the second contacting tool into the outer region;

bringing the second contacting tool into contact with the inner surface of the base region; and applying an energy to at least one of the first contacting tool and the second contacting tool to establish a connection between the first electrical contact element and the electrical conductor comprising the electrical conductor connecting to the base region on an outer side of the base region, the connection not being disconnectable without destruction.

* * * * *